US011602183B2

(12) United States Patent
Lemieux

(10) Patent No.: US 11,602,183 B2
(45) Date of Patent: Mar. 14, 2023

(54) SPORTS GLOVE WITH AN ADJUSTABLE CUFF

(71) Applicant: BAUER PERFORMANCE LACROSSE INC., Liverpool, NY (US)

(72) Inventor: Eric Lemieux, St-Sauveur (CA)

(73) Assignee: CASCADE MAVERIK LACROSSE, LLC, Liverpool, NY (US)

( * ) Notice: Subject to any disclaimer, the term of this patent is extended or adjusted under 35 U.S.C. 154(b) by 174 days.

(21) Appl. No.: 14/220,438

(22) Filed: Mar. 20, 2014

(65) Prior Publication Data

US 2015/0265904 A1 Sep. 24, 2015

(51) Int. Cl.

| | |
|---|---|
| ***A41D 19/00*** | (2006.01) |
| ***A63B 71/14*** | (2006.01) |
| ***A63B 102/14*** | (2015.01) |
| *A63B 102/24* | (2015.01) |

(52) U.S. Cl.

CPC ..... *A41D 19/0048* (2013.01); *A41D 19/0044* (2013.01); *A63B 71/143* (2013.01); *A41D 2300/32* (2013.01); *A63B 2102/14* (2015.10); *A63B 2102/24* (2015.10); *A63B 2209/10* (2013.01); *A63B 2225/09* (2013.01)

(58) Field of Classification Search

CPC ..... A41D 19/0044; A41D 19/0048; A41D 2300/32; A41D 19/015; A41D 19/1523; A41F 1/06; A41F 1/00; A63B 71/14; A63B 71/141; A63B 71/143; A63B 2243/005; A63B 2225/09; A63B 2102/14; A63B 2209/10; A41B 7/02

USPC ..... 2/20, 161.1, 162, 163, 167, 159, 160, 2/161.4, 123, 128, 170; 24/904; 63/3

See application file for complete search history.

(56) References Cited

U.S. PATENT DOCUMENTS 251,272 A * 12/1881 Moller ..... F16G 11/12 24/68 R
689,558 A * 12/1901 Meyers ..... A41D 19/00 2/159

(Continued)

FOREIGN PATENT DOCUMENTS

| | | | |
|---|---|---|---|
| CA | 2137027 | 5/1996 | |
| CA | 2285508 | 4/2001 | |
| CA | 2285508 A1 * | 4/2001 | ..... A63B 71/143 |

OTHER PUBLICATIONS

Examiner's report dated Jul. 13, 2015 in connection with Canadian Patent Application 2,852,819, 5 pages.

(Continued)

*Primary Examiner* — Jocelyn Bravo

(57) ABSTRACT

A sports glove, such as a lacrosse glove or a hockey glove, for a player or other wearer. The sports glove comprises a hand covering for protecting a hand of the wearer. The hand covering comprises protective padding. The hand covering comprises a palm portion for overlying a palm of the wearer's hand, a back portion for overlying a back of the wearer's hand, finger portions for receiving fingers of the wearer's hand, and a thumb portion for receiving a thumb of the wearer's hand. The sports glove comprises a cuff for overlying a wrist of the wearer. The cuff comprises protective padding. The cuff is adjustable. For example, the cuff may be flared relative to the hand covering and configured such that a flare of the cuff is adjustable.

22 Claims, 10 Drawing Sheets

(56) References Cited

U.S. PATENT DOCUMENTS 752,769 A * 2/1904 Graichen ..... A41D 19/0044 2/162
970,958 A * 9/1910 Schulherr ..... A41D 19/02 2/169
1,149,139 A * 8/1915 Heagle ..... A41D 19/00 2/159
3,387,306 A * 6/1968 Korey ..... A63B 71/146 2/159
4,853,975 A * 8/1989 Clevenhagen ..... A63B 71/143 2/19
4,868,927 A * 9/1989 Bourdeau ..... A41F 1/06 2/161.1
5,170,508 A * 12/1992 Kawada ..... 2/161.4
5,488,739 A * 2/1996 Cardinal ..... A63B 71/143 2/163
5,557,805 A * 9/1996 Emerson ..... 2/158
5,781,929 A * 7/1998 Shikatani ..... 2/16
5,787,506 A 8/1998 Wilder et al.
5,983,396 A * 11/1999 Morrow et al. ..... 2/161.1
6,085,354 A 7/2000 Wilder et al.
6,122,769 A 9/2000 Wilder et al.
6,275,996 B1 * 8/2001 Redwood et al. ..... 2/160
6,418,560 B1 * 7/2002 Emechete ..... 2/161.4
6,543,057 B2 * 4/2003 Beland ..... A63B 71/143 2/16
6,550,069 B1 4/2003 Morrow
6,584,615 B1 * 7/2003 Wilder et al. ..... 2/16
6,704,936 B1 * 3/2004 Carlin ..... 2/18
6,813,780 B2 11/2004 Morrow
7,117,540 B2 10/2006 Morrow
7,318,241 B2 1/2008 Morrow
7,636,951 B2 * 12/2009 Morrow et al. ..... 2/161.1
7,900,275 B2 * 3/2011 Morrow et al. ..... 2/161.1
8,230,524 B1 * 7/2012 Safford ..... 2/162
8,359,667 B2 * 1/2013 Clark ..... 2/161.1
2002/0152537 A1 * 10/2002 Litke ..... 2/161.4
2003/0163862 A1 * 9/2003 Hoffman ..... A63B 71/143 2/161.1
2003/0233695 A1 * 12/2003 Golde ..... A41D 19/015 2/161.1
2008/0083048 A1 * 4/2008 Morrow et al. ..... A63B 71/143 2/16
2008/0120753 A1 * 5/2008 Desjardins ..... A41D 13/088 2/16
2009/0222972 A1 * 9/2009 Joung ..... 2/161.3
2010/0186138 A1 * 7/2010 Hale ..... A41D 13/0015 2/116
2011/0197336 A1 * 8/2011 Suk ..... 2/161.3
2012/0054937 A1 * 3/2012 Robaire et al. ..... 2/16
2012/0159681 A1 * 6/2012 Gibby ..... 2/20
2013/0283498 A1 * 10/2013 Hewitt ..... A63B 71/141 2/161.1
2014/0033392 A1 * 2/2014 Bulan et al. ..... 2/16
2014/0143926 A1 * 5/2014 Brown et al. ..... 2/20

OTHER PUBLICATIONS

Examiner's Report issued by the Canadian Intellectual Property Office (CIPO) in connection with Canadian patent application No. 2,852,819 dated Apr. 14, 2020—4 pages.

* cited by examiner

SPORTS GLOVE WITH AN ADJUSTABLE CUFF

FIELD OF THE INVENTION

The invention relates generally to sports gloves for lacrosse, hockey, and/or other sports.

BACKGROUND

Protective sports gloves, as used in many sports such as lacrosse and hockey amongst others, are designed for protecting a player's hands, notably protecting them from any impact or other contact which could otherwise cause pain or injury. However, it is also important for sports gloves to provide mobility so as to avoid unduly impeding movement of the player's hands and/or wrists when, for example, handling a stick (e.g., a lacrosse stick or a hockey stick) or other sports implement.

Having sports gloves that provide a lot of protection may sometimes detrimentally affect performance and/or comfort of a player if he/she finds himself/herself impaired when, for example, he/she tries to flex his/her hands and/or wrists. Thus, striking a balance between optimum protection and mobility is important in designing sports gloves. In some cases, this may prove challenging since different players may have different preferences in terms of protection and mobility.

While various designs of sports gloves have been used to balance protection and mobility, there remains a need for improvements in sports gloves that may allow adjustment of a level of protection and/or a level of mobility of a player's hands that the sports gloves afford.

SUMMARY OF THE INVENTION

According to an aspect of the invention, there is provided a sports glove for a wearer. The sports glove comprises a hand covering for protecting a hand of the wearer. The hand covering comprises protective padding. The hand covering comprises a palm portion for overlying a palm of the wearer's hand, a back portion for overlying a back of the wearer's hand, finger portions for receiving fingers of the wearer's hand, and a thumb portion for receiving a thumb of the wearer's hand. The sports glove comprises a cuff for overlying a wrist of the wearer. The cuff comprises protective padding. The cuff is flared relative to the hand covering and configured such that a flare of the cuff is adjustable.

According to another aspect of the invention, there is provided a sports glove for a wearer. The sports glove comprises a hand covering for protecting a hand of the wearer. The hand covering comprises protective padding. The hand covering comprises a palm portion for overlying a palm of the wearer's hand, a back portion for overlying a back of the wearer's hand, finger portions for receiving fingers of the wearer's hand, and a thumb portion for receiving a thumb of the wearer's hand. The sports glove comprises a cuff for overlying a wrist of the wearer. The cuff comprises protective padding. The cuff comprises: a plurality of cuff members movable relative to one another; and a fastener to fasten a first one of the cuff members and a second one of the cuff members. The first one of the cuff members and the second one of the cuff members overlap when fastened.

According to another aspect of the invention, there is provided a sports glove for a wearer. The sports glove comprises a hand covering for protecting a hand of the wearer. The hand covering comprises protective padding. The hand covering comprises a palm portion for overlying a palm of the wearer's hand, a back portion for overlying a back of the wearer's hand, finger portions for receiving fingers of the wearer's hand, and a thumb portion for receiving a thumb of the wearer's hand. The sports glove comprises a cuff for overlying a wrist of the wearer. The cuff comprises protective padding. The cuff comprises: a plurality of cuff members movable relative to one another; a first fastener to fasten a first one of the cuff members and a second one of the cuff members; and a second fastener to fasten the first one of the cuff members and a third one of the cuff members.

These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

Figure 1:
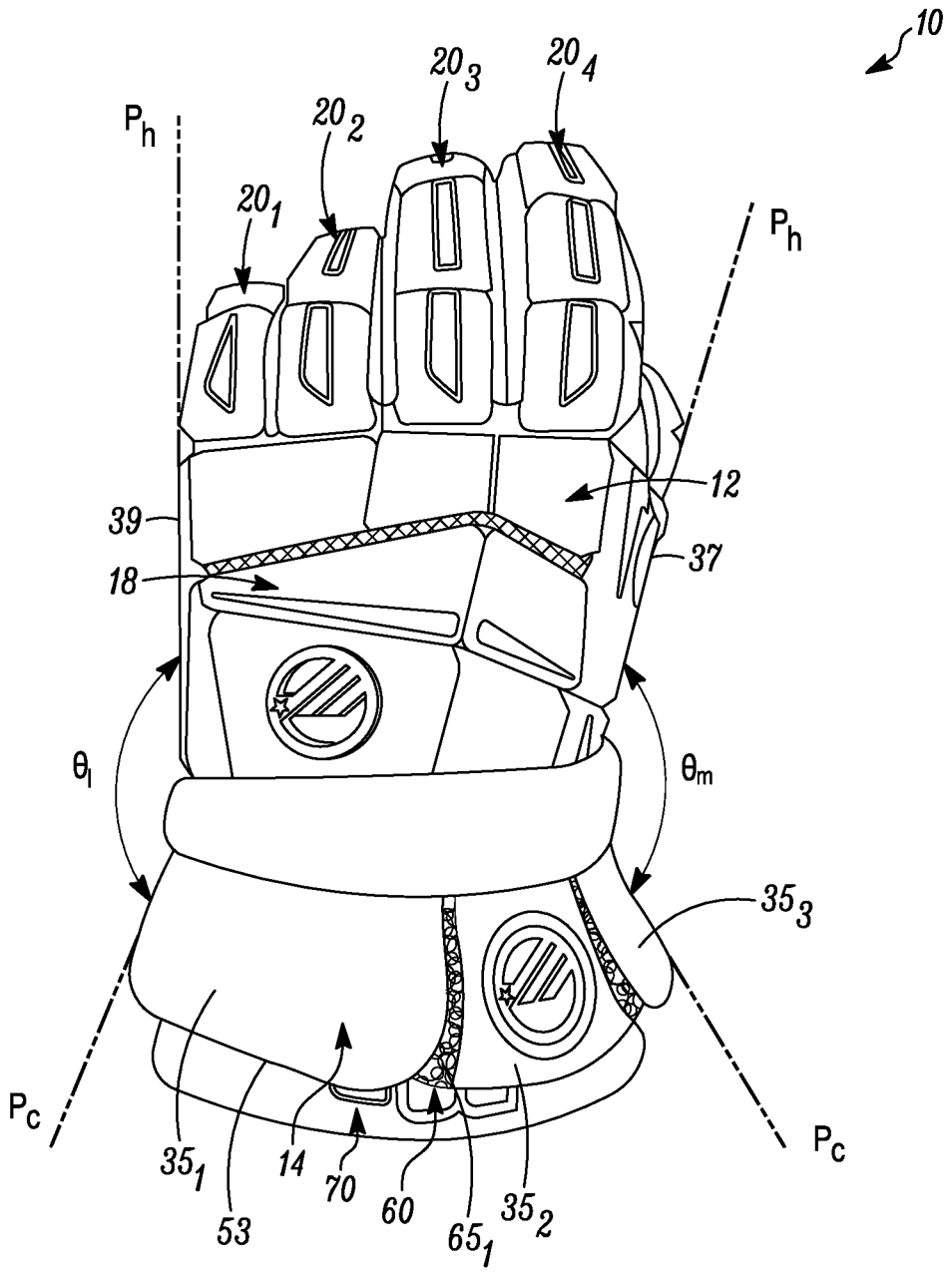
FIG. 1 shows a back view of a sports glove in accordance with an embodiment of the invention.
Figure 2:
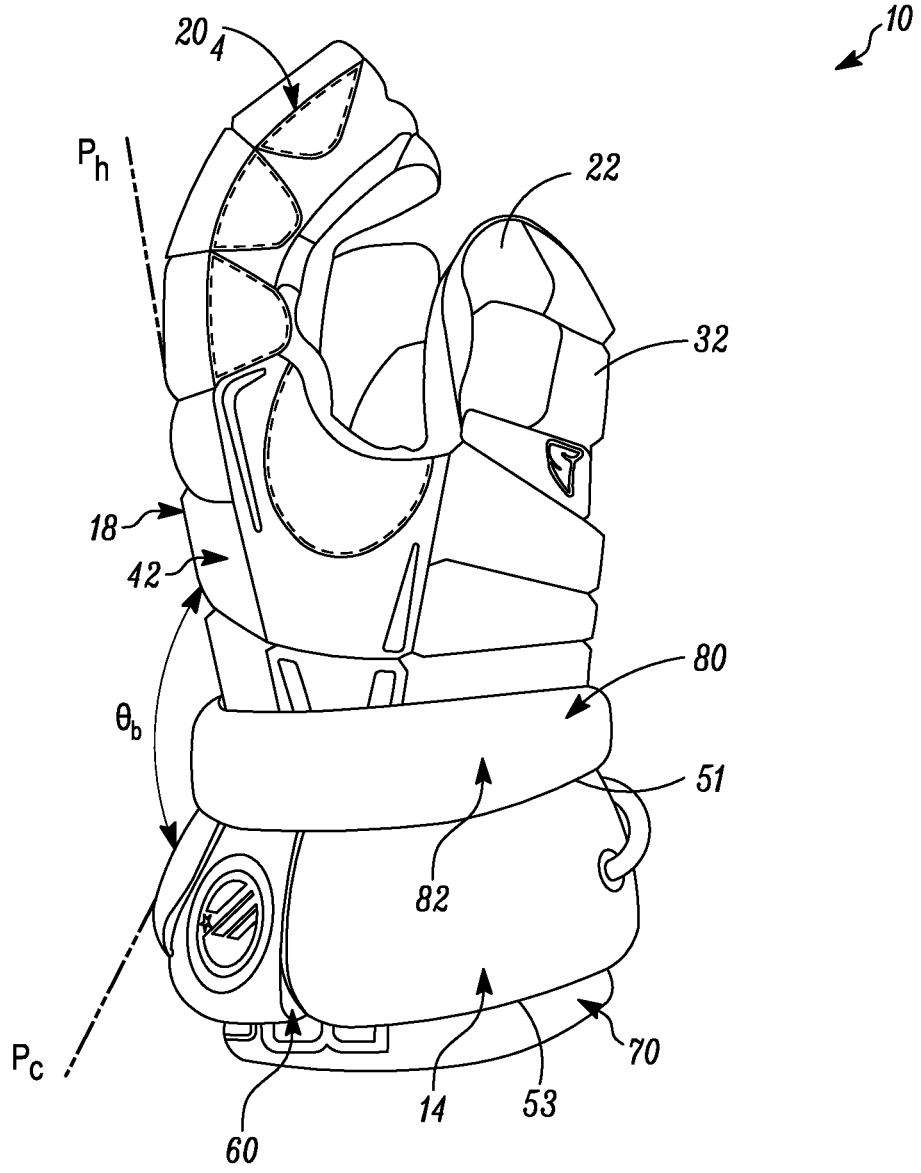
FIG. 2 shows a side view of the sports glove.
Figure 3:
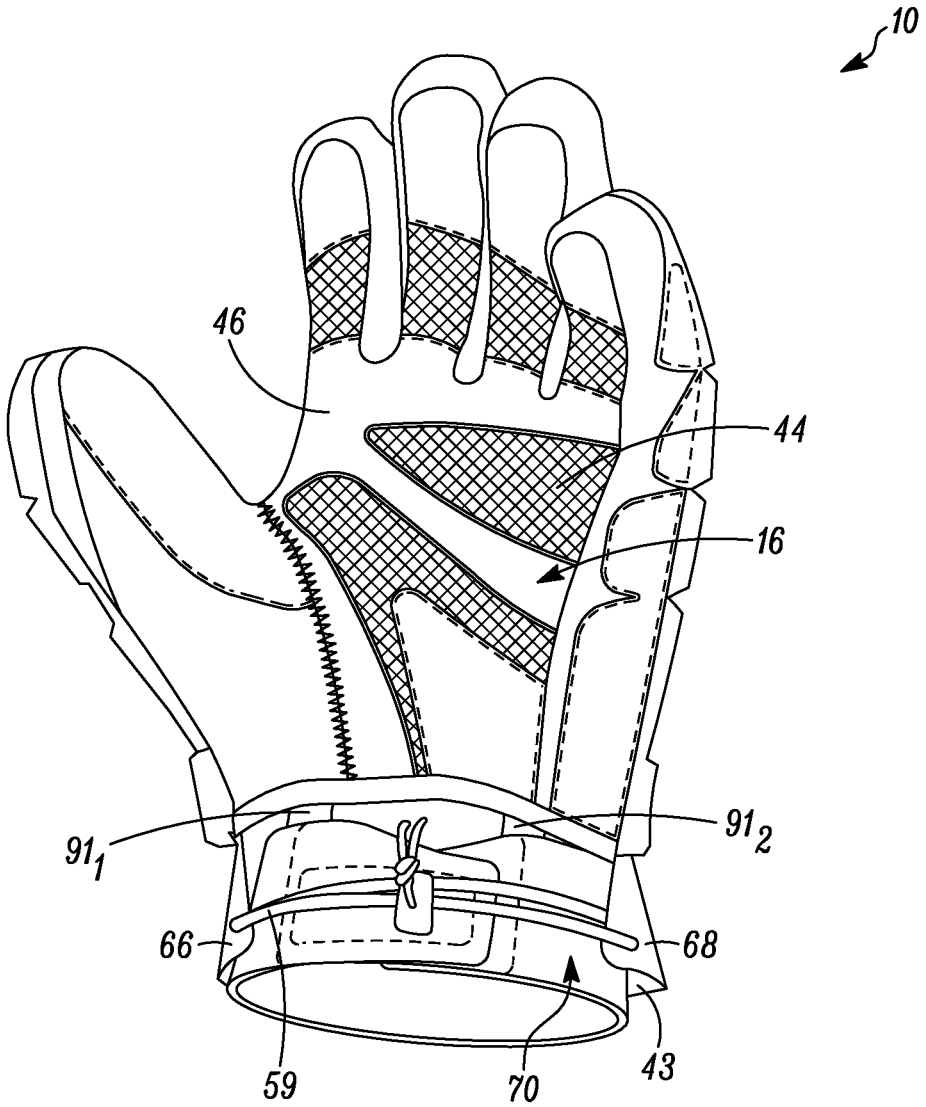
FIG. 3 shows a palm view of the sports glove.
Figure 4:
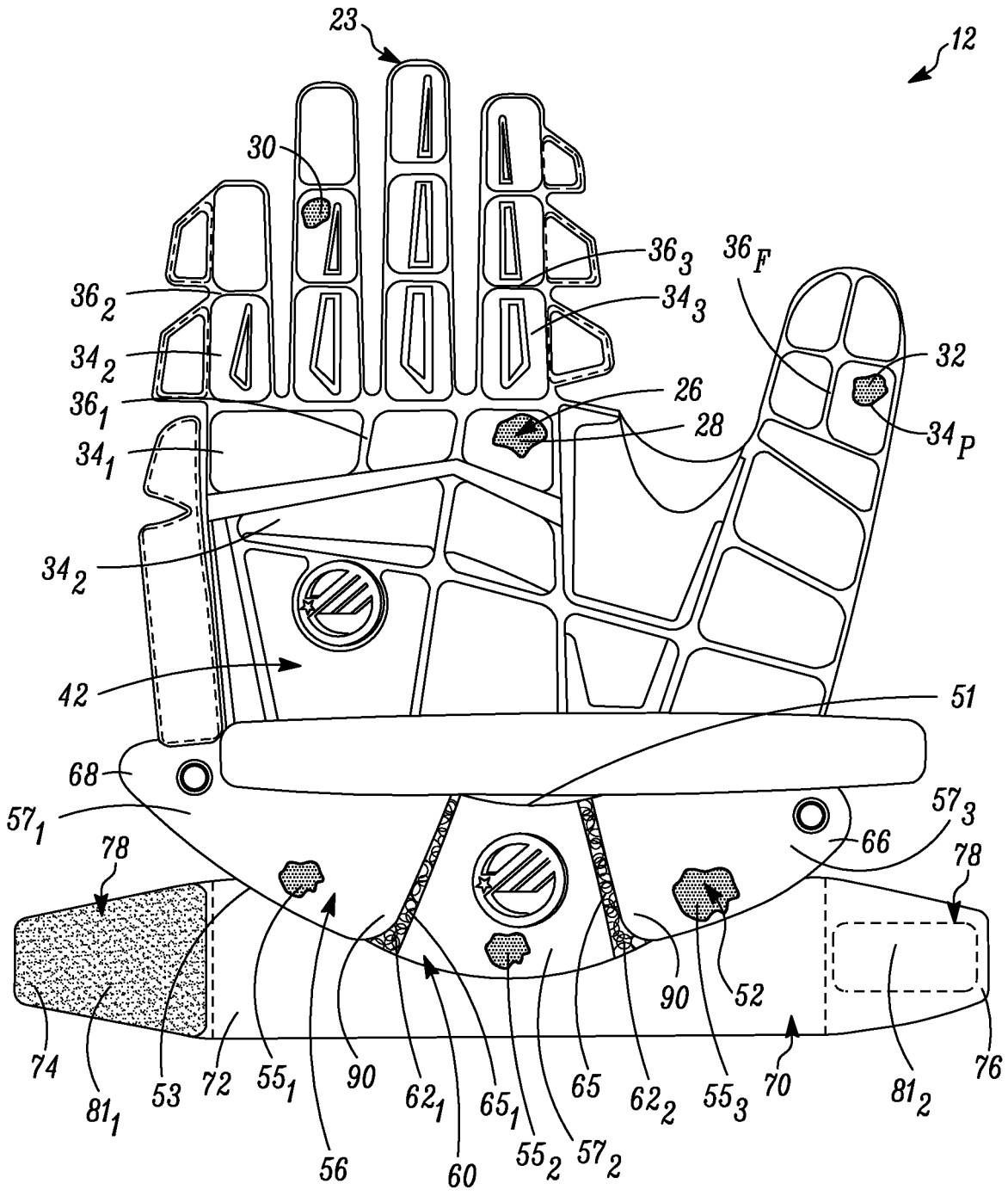
FIGS. 4 and 5 show plan views of parts of the sports glove in a partly-disassembled state, from a back side and a palm side of the sports glove, respectively.
Figure 5:
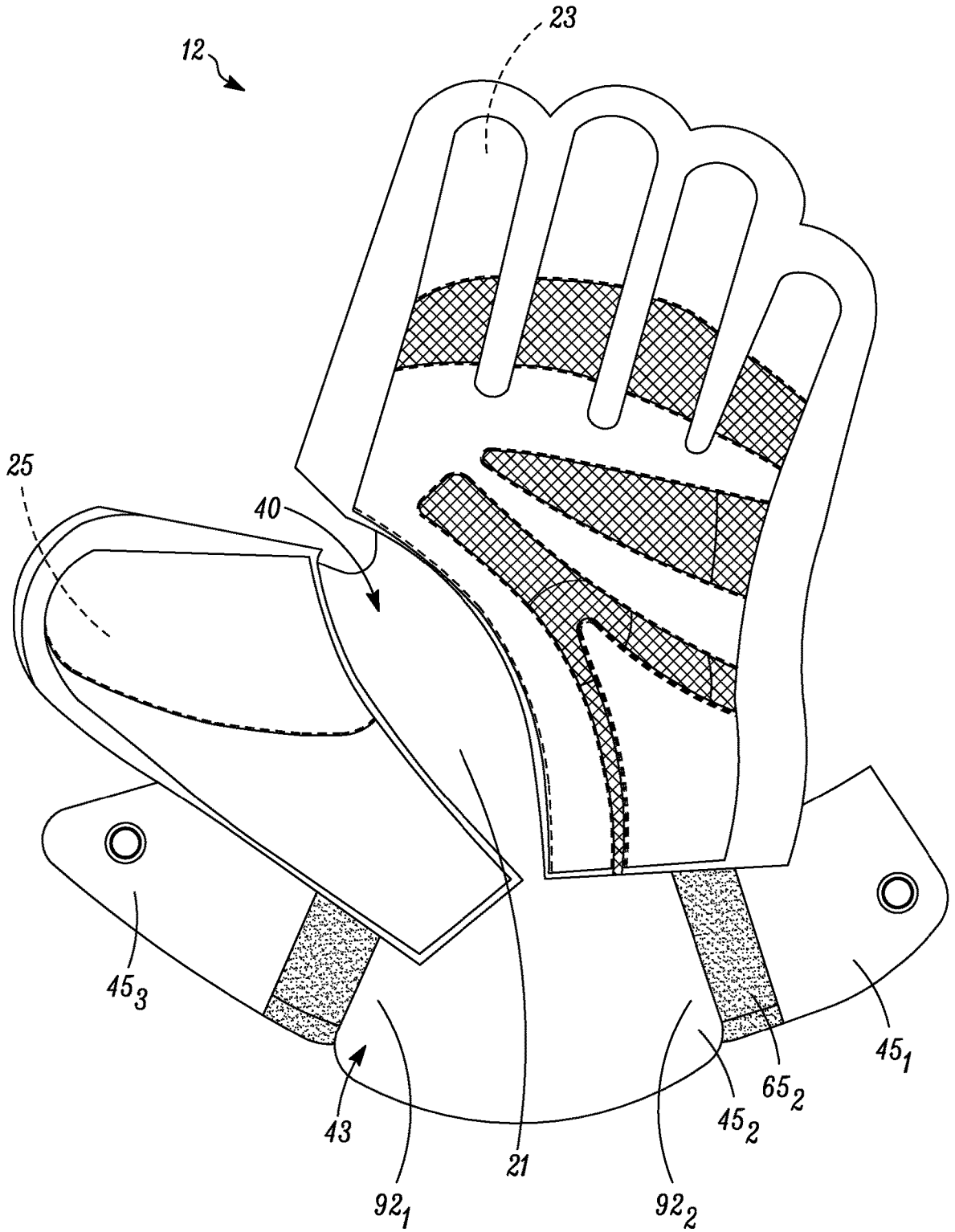

FIGS. 1 to 3 show an example of a sports glove 10 in accordance with an embodiment of the invention. The sports glove 10 is wearable by a wearer engaging in a sport. In this embodiment, the glove 10 is a lacrosse glove and the wearer is a lacrosse player playing lacrosse.

The glove 10 comprises a hand covering 12 for protecting a hand of the player and a cuff 14 for overlying a wrist of the player. As further discussed later, in this embodiment, the cuff 14 is adjustable as desired by the player. This may allow a fit of the glove 10 and a range of motion and protection of the player's hand to be customized or personalized to some extent. This may also allow the glove 10 and a similar glove on the player's other hand to be adjusted differently.

The hand covering 12 comprises a palm portion 16 for overlying a palm of the player's hand, a back portion 18 for overlying a back of the player's hand, finger portions $\mathbf{20}_1$-$\mathbf{20}_4$ for receiving fingers of the player's hand, and a thumb portion 22 for receiving a thumb of the player's hand.

The hand covering 12 is padded to protect the player's hand. That is, the hand covering 12 comprises protective padding 26. More particularly, in this embodiment, the protective padding 26 comprises protective padding 28 in the back portion 18, protective padding 30 in a back side of each of the finger portions $\mathbf{20}_1$-$\mathbf{20}_4$, and protective padding 32 in a back side of the thumb portion 22. In this example, each of the protective padding 28, the protective padding 30, and the protective padding 32 includes a plurality of pad members $\mathbf{34}_1$-$\mathbf{34}_P$ that are movable relative to one another to facilitate flexion of the player's hand, including flexion of each of the player's fingers and thumb. Flex lines $\mathbf{36}_1$-$\mathbf{36}_F$ (e.g., seams) extend between respective ones of the pad members $\mathbf{34}_1$-$\mathbf{34}_P$ to facilitate flexion of the glove 10 at the flex lines $\mathbf{36}_1$-$\mathbf{36}_F$.

The protective padding 26 may comprise any suitable impact-absorbing material. For example, in this embodiment, the protective padding 26 comprises foam. For instance, in some examples of implementation, the foam may be ethylene vinyl acetate (EVA) foam, expanded polypropylene (EPP) foam, expanded polyethylene (EPE) foam (e.g., low-density polyethylene (LDPE) foam), vinyl nitrile (VN) foam, polyurethane foam, or any other suitable foam. Also, in some embodiment, the protective padding 26 may comprise a gel.

In addition to the protective padding 26, in this embodiment, the hand covering 12 comprises an inner liner 40 and an outer cover 42 between which the protective padding 26 is disposed. More particularly, in this embodiment, the inner liner 40 comprises an inner liner 21 in the back portion 18, an inner liner 23 in a back side of each of the finger portions $\mathbf{20}_1$-$\mathbf{20}_4$, and an inner liner 25 in a back side of the thumb portion 22.

The inner liner 40 and the outer cover 42 may comprise any suitable material. In this embodiment, the inner liner 40 comprises fabric. For instance, in some examples of implementation, the fabric of the inner liner 51 may comprise a woven fabric, a nonwoven fabric, or any other suitable fabric. Also, in this embodiment, the outer cover 42 comprises flexible non-foam polymeric material. For instance, in some cases, the flexible non-foam polymeric material of the outer cover 42 may comprise polyurethane.

The palm portion 16 of the hand covering 12 may comprise any suitable material. In this embodiment, the palm portion 16 comprises breathable material 44 to provide ventilation of the player's hand. For example, in this case, the breathable material 44 comprises mesh. Also, in this embodiment, the palm portion 16 comprises wear-resistant material 46 to enhance a resistance to wear of the palm portion 16. The wear-resistant material 46 has a greater wear resistance than the breathable material 44. For instance, in some examples of implementation, the wear-resistant material 46 may comprise leather (e.g., synthetic leather), suede (e.g., synthetic suede) or any other suitable material.

The hand covering 12 may be implemented in various other ways in other embodiments (e.g., may comprise any suitable materials arranged in any suitable manner).

The cuff 14 extends rearwardly from the hand covering 12 to overly the player's wrist. In this example, the cuff 14 also overlies a distal region of a forearm of the player adjacent to the player's wrist.

In this embodiment, the cuff 14 comprises protective padding 52 to protect the player's wrist and forearm. The protective padding 52 may comprise any suitable impact-absorbing material. For example, in this embodiment, the protective padding 52 comprises foam. For instance, in some examples of implementation, the foam may be ethylene vinyl acetate (EVA) foam, expanded polypropylene (EPP) foam, expanded polyethylene (EPE) foam (e.g., low-density polyethylene (LDPE) foam), vinyl nitrile (VN) foam, polyurethane foam, or any other suitable foam. In other embodiments, the protective padding 52 may comprise material other than foam.

Also, in this example, the cuff 14 comprises an inner liner 43 and an outer cover 56 between which the protective padding 52 is disposed. The inner liner 43 faces the player's wrist and forearm and may comprise any suitable material. For example, in this embodiment, the inner liner 43 comprises fabric. For instance, in some examples of implementation, the fabric of the inner liner 43 may comprise a woven fabric, a nonwoven fabric, or any other suitable fabric. The inner liner 43 may be implemented in various other ways in other embodiments. The outer cover 56 faces away from the player's wrist and forearm and may comprise any suitable material. For example, in this embodiment, the outer cover 56 comprises flexible non-foam polymeric material. For instance, in some cases, the flexible non-foam polymeric material of the outer cover 56 may comprise polyurethane. The outer cover 53 may be implemented in various other ways in other embodiments.

In this embodiment, the cuff 14 comprises a plurality of cuff members $\mathbf{35}_1$-$\mathbf{35}_3$ movable relative to one another. This may sometimes be referred to as a "split cuff" design. This may provide flexibility and facilitate adjustment of the cuff 14, as further discussed later. The protective padding 52 comprises protective padding $\mathbf{55}_1$ of the cuff member $\mathbf{35}_1$, protective padding $\mathbf{55}_2$ of the cuff member $\mathbf{35}_2$, and protective padding $\mathbf{55}_3$ of the cuff member $\mathbf{35}_3$. Similarly, the inner liner 43 and the outer cover 56 respectively comprise an inner liner $\mathbf{45}_1$ and an outer cover $\mathbf{57}_1$ of cuff member $\mathbf{35}_1$; an inner liner $\mathbf{45}_2$ and an outer cover $\mathbf{57}_2$ of cuff member; and an inner liner $\mathbf{45}_3$ and an outer cover $\mathbf{57}_3$ of cuff member $\mathbf{35}_3$.

The cuff 14 is flared relative to the hand covering 12. That is, the cuff 14 spreads outwardly relative to the hand covering 12. A flare of the cuff 14 is such that the cuff 14 extends away from the player's wrist and forearm from a front edge 51 of the cuff 14 to a rear edge 53 of the cuff 14. The rear edge 53 of the cuff 14 is thus disposed outward of the front edge 51 of the cuff 14, i.e., further away from the player's wrist and forearm than the front edge region 51 of the cuff 14. By being flared, the cuff 14 provides more flexibility to the player who can flex or otherwise move his/her wrist with a greater range of motion unimpeded by the cuff 14.

The flare of the cuff 14 can be measured as an angle $\theta$ between the cuff 14 and the hand covering 12. The angle $\theta$ is defined between (i) a straight line $P_c$ extending through the front edge 51 of the cuff 14 and the rear edge 53 of the cuff 14 and (ii) a straight line $P_h$ tangent to the hand covering 12 and intersecting the straight line $P_c$ at the front edge 51 of the cuff 14. The angle $\theta$ can be taken at various locations on the glove 10, such as an angle $\theta_b$ between the cuff 14 and the back portion 18 of the hand covering 12, an angle $\theta_m$ between the cuff 14 and a medial side 37 of the hand covering 12, or an angle $\theta_l$ between the cuff 14 and a lateral side 39 of the hand covering 12.

The cuff 14 is configured such that it is adjustable. This may allow the player to tailor how the glove 10 fits, how much the player's wrist can flex without being impeded by the cuff 14, and how much protection is provided by the cuff 14.

To that end, the cuff 14 comprises a cuff adjuster 60 to adjust the cuff 14. Various aspects of the cuff 14 may be adjustable by the cuff adjuster 60. Notably, in this embodiment, the cuff adjuster 60 allows the flare of the cuff 14 to be adjusted. In that sense, in this example, the cuff adjuster 60 may also be referred to as a "flare adjuster". For instance, the flare of the cuff 14 may be greater (i.e., the angle θ may be smaller) when a greater range of motion of the player's wrist is desired, while the flare of the cuff 14 may be smaller (i.e., the angle θ may be greater) when more protection of the player's wrist and forearm is desired.

Figure 6A:
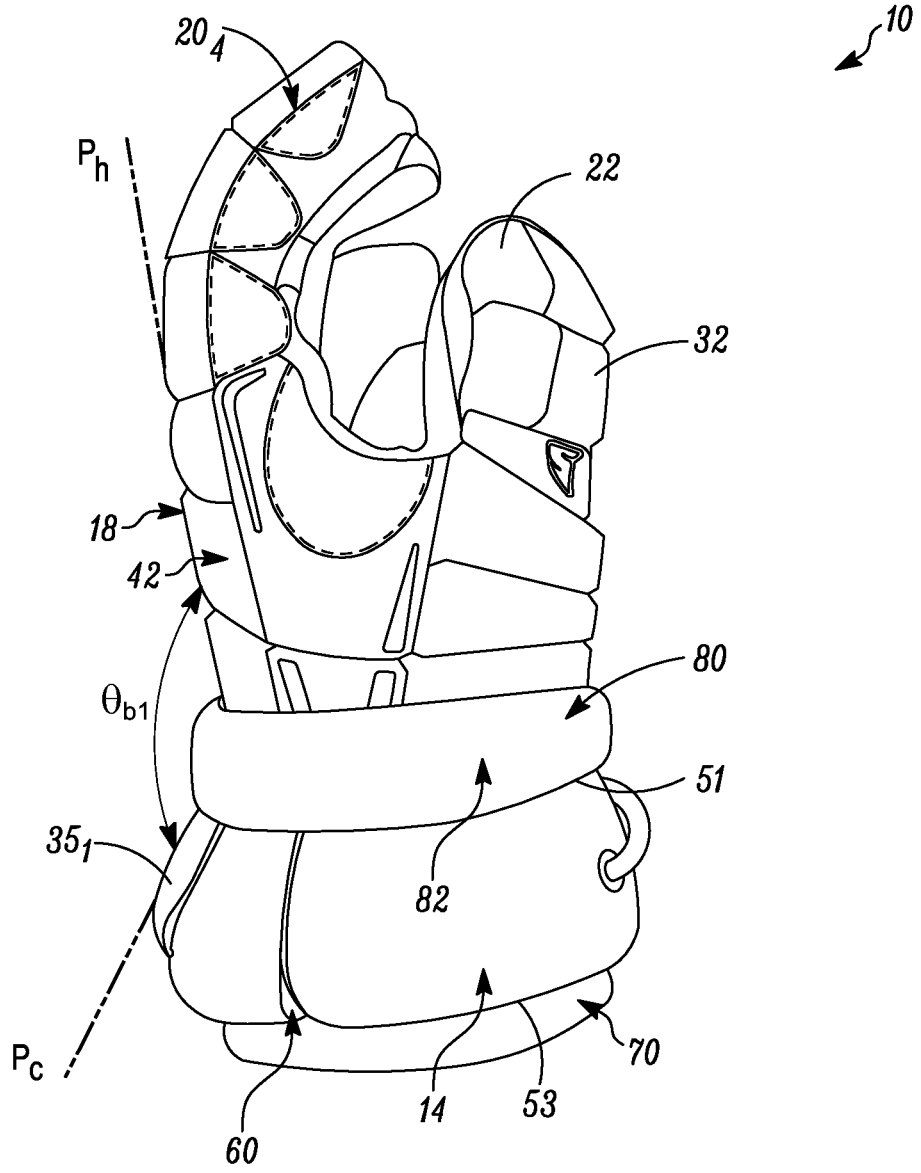
FIGS. 6A and 6B respectively show different positions of cuff members of a cuff of the sports glove.
Figure 6B:
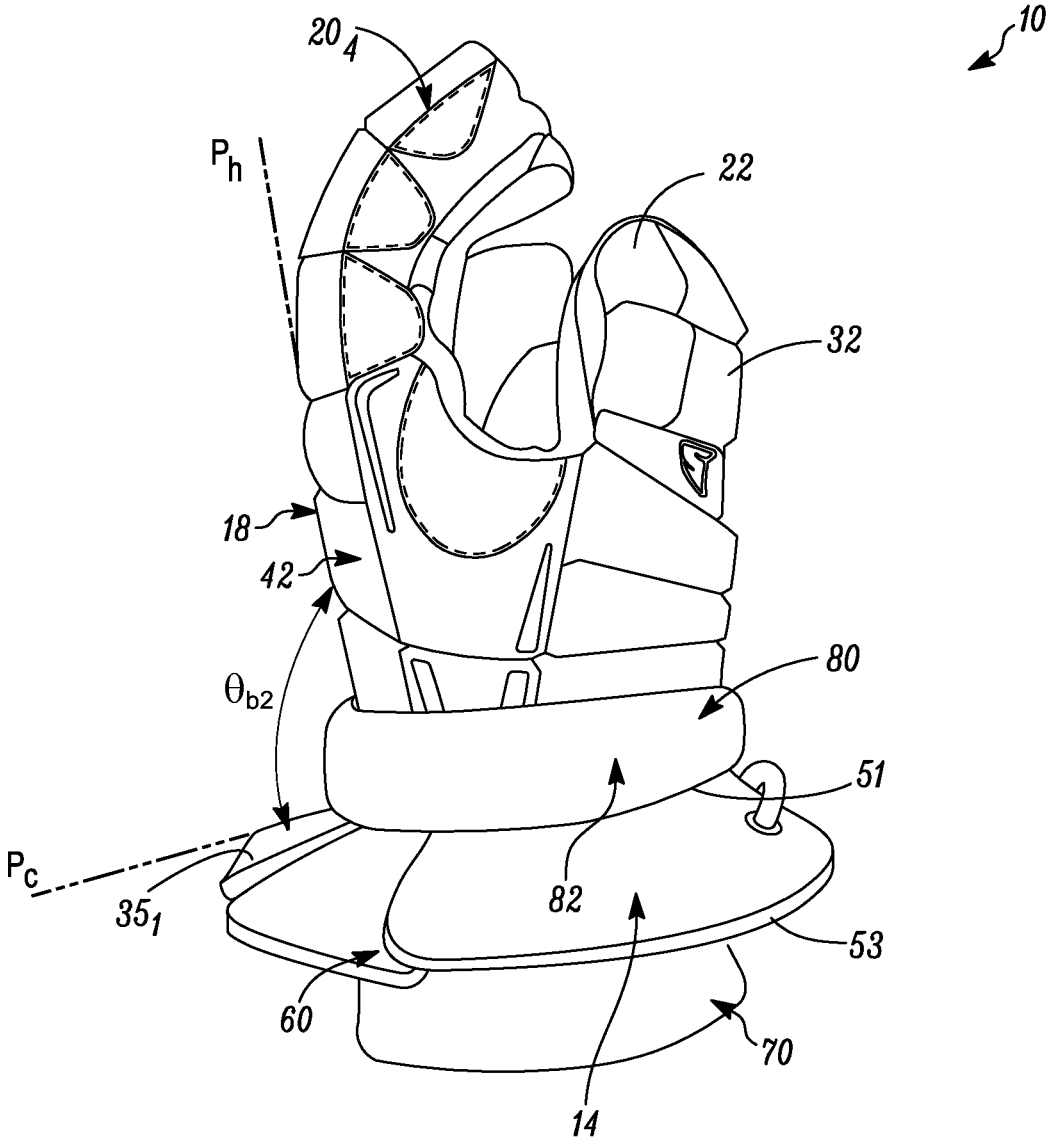
Figure 6C:
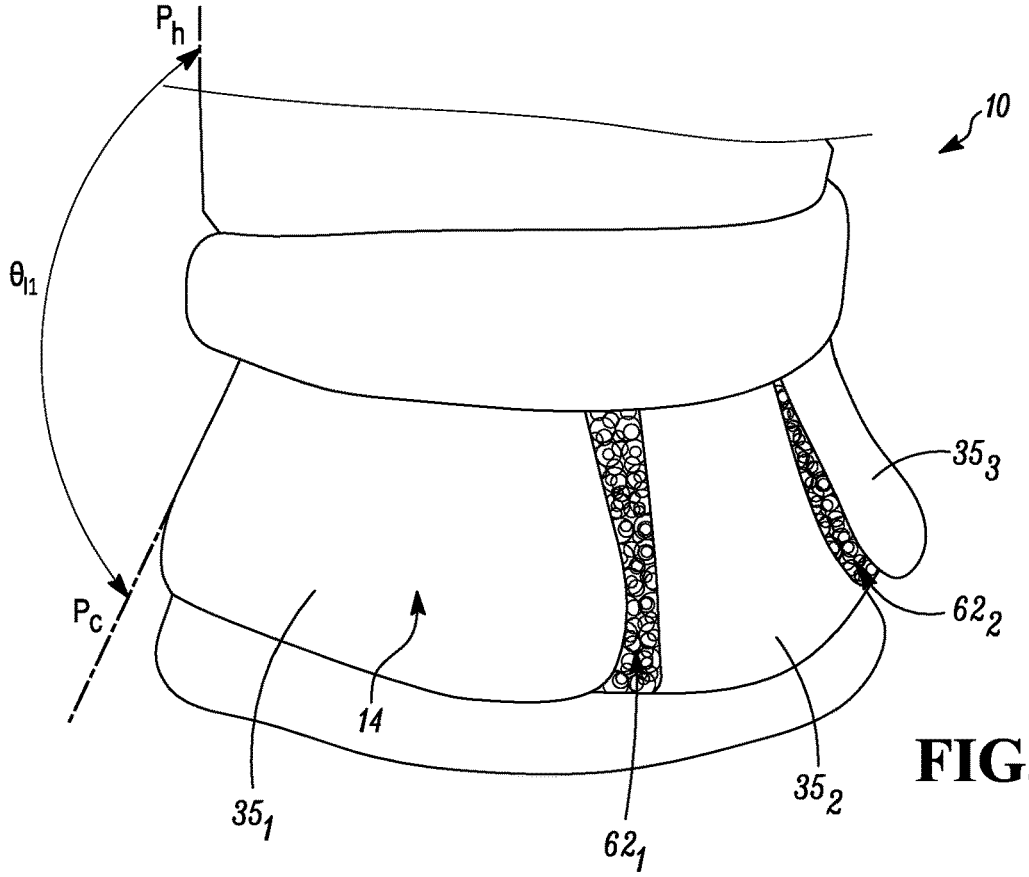
FIGS. 6C and 6D respectively show other different positions of the cuff members.
Figure 6D:
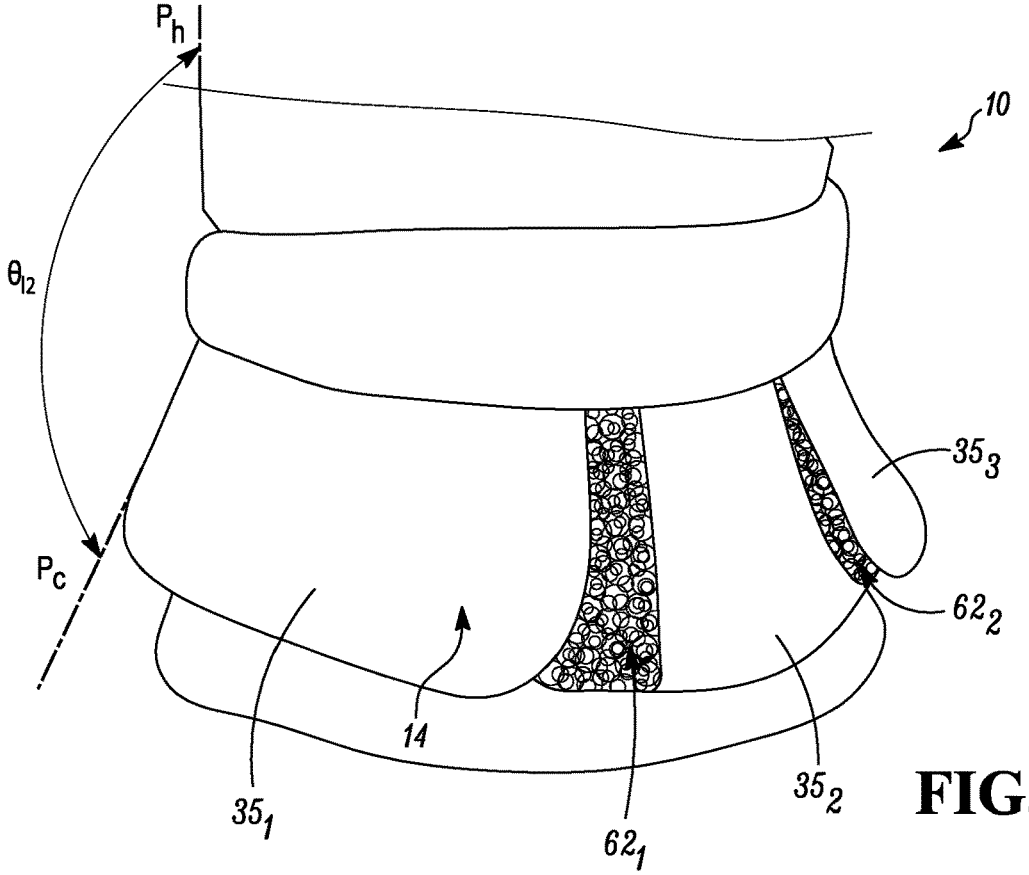
Figure 7A:
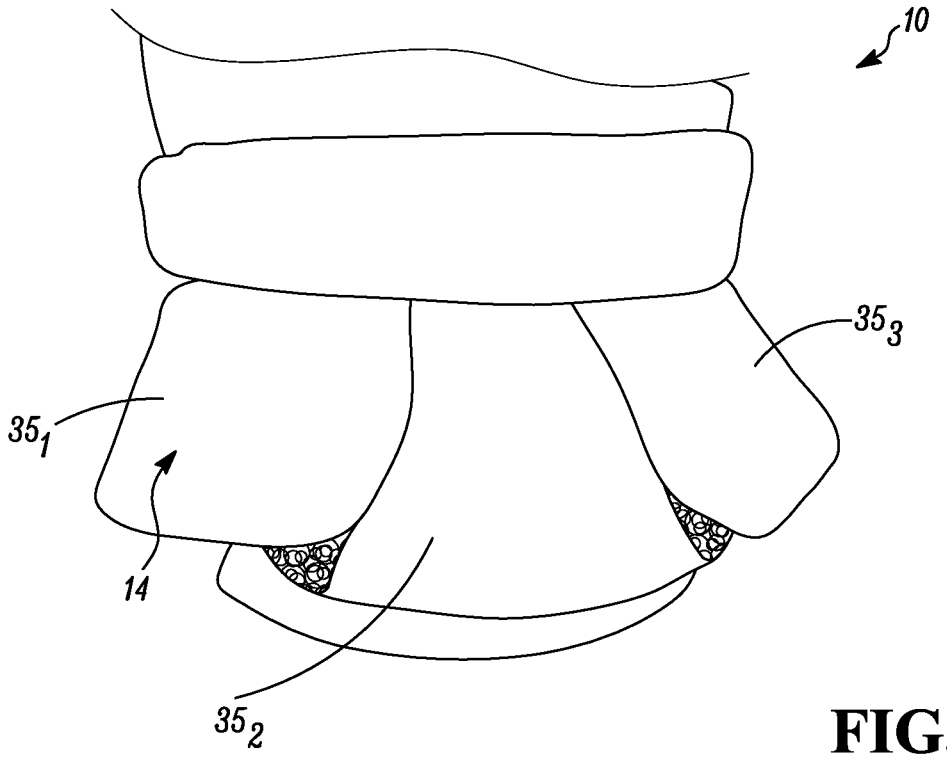
FIGS. 7A and 7B respectively show other different positions of the cuff members.
Figure 7B:
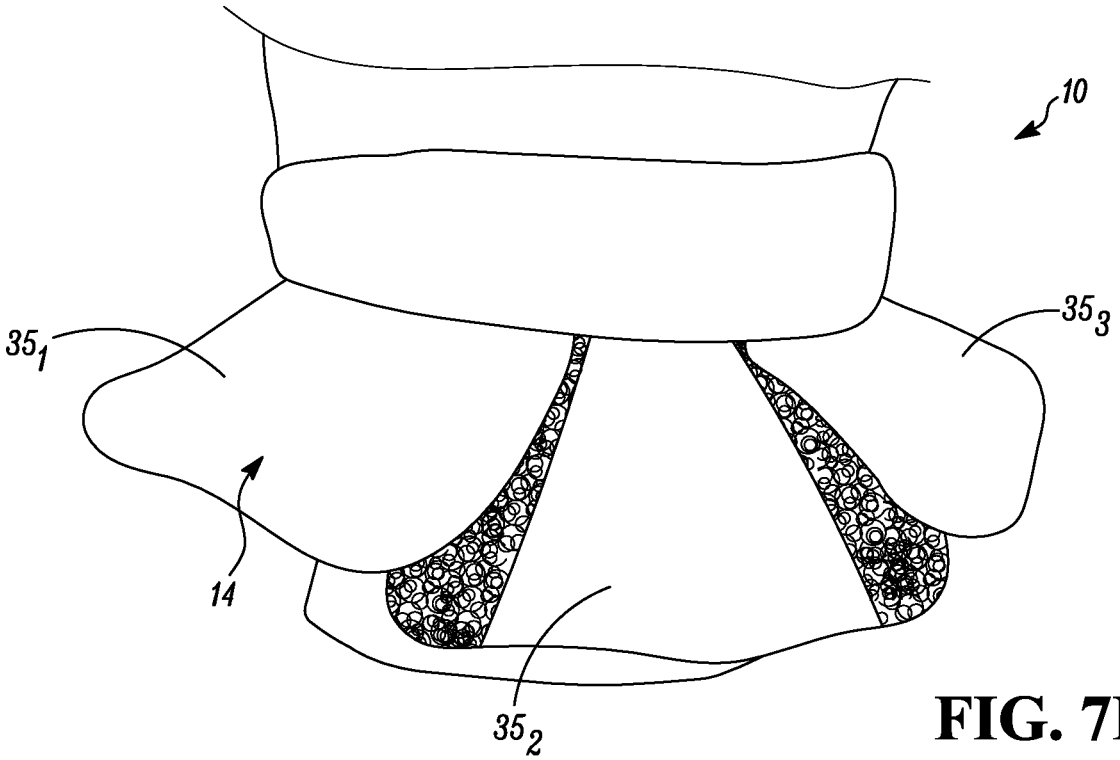

For example, as shown in FIGS. 6A and 6B, in a first position, the cuff member $\mathbf{35}_1$ may form an angle $\theta_{b1}$ with respect to the plane $P_h$, while in a second position, the cuff member $\mathbf{35}_1$ may form an angle $\theta_{b2}$ with respect to the plane $P_h$ that is less than the angle $\theta_{b1}$ such that the flare of the cuff 14 is greater when the cuff member $\mathbf{35}_1$ is in the second position (FIG. 6B) than in the first position (FIG. 6A). As another example, as shown in FIGS. 6C and 6D, in a first position, the cuff member $\mathbf{35}_1$ may form an angle $\theta_{l1}$ with respect to the plane $P_h$, while in a second position, the cuff member $\mathbf{35}_1$ may form an angle $\theta_{l2}$ with respect to the plane $P_h$ that is less than the angle $\theta_{l1}$ such that the flare of the cuff 14 is greater when the cuff member $\mathbf{35}_1$ is in the second position (FIG. 6D) than in the first position (FIG. 6C). FIGS. 7A and 7B show other positions of the cuff members $\mathbf{35}_1$-$\mathbf{35}_3$ illustrating how the flare of the cuff 14 can be adjusted to a minimum (e.g., a "closed" flare) as shown in FIG. 7A or a maximum as shown in FIG. 7B, or to any degree in between.

In this embodiment, the cuff adjuster 60 comprises a plurality of fasteners $\mathbf{62}_1$, $\mathbf{62}_2$ operable to adjust the cuff 14. In this case, the fasteners $\mathbf{62}_1$, $\mathbf{62}_2$ are operable to adjust the flare of the cuff 14. Each of the fasteners $\mathbf{62}_1$, $\mathbf{62}_2$ is located on the cuff 14 between and away from a first longitudinal end 66 and a second longitudinal end 68 of the cuff 14. In this example of implementation, a lace 59 interconnects the longitudinal ends 66, 68 of the cuff 14 by extending underneath the player's wrist or forearm when the glove 10 is worn to allow tightening or loosening of the cuff 14. In contrast, each of the fasteners $\mathbf{62}_1$, $\mathbf{62}_2$ is operable to adjust the cuff 14 without extending underneath the player's wrist or forearm when the glove 10 is worn.

Furthermore, in this embodiment, each of the fasteners $\mathbf{62}_1$, $\mathbf{62}_2$ comprises a first fastening element $\mathbf{65}_1$ on a respective one of opposite longitudinal end regions $\mathbf{92}_1$ and $\mathbf{92}_2$ of the cuff member $\mathbf{35}_2$ and a second fastening element $\mathbf{65}_2$ on a longitudinal end region 90 of a respective one of the cuff members $\mathbf{35}_1$, $\mathbf{35}_3$. In this embodiment, each of the fasteners $\mathbf{62}_1$, $\mathbf{62}_2$ comprises a hook-and-loop fastener. In this case, the fastening element $\mathbf{65}_1$ of each of the hook-and-loop fasteners $\mathbf{62}_1$, $\mathbf{62}_2$ comprises a hook element of that hook-and-loop fastener, and the fastening element $\mathbf{65}_2$ comprises a loop element of that hook-and-loop fastener. In other cases, this may be reversed.

More particularly, in this embodiment, the fastener $\mathbf{62}_1$ is configured to fasten the cuff member $\mathbf{35}_1$ and the cuff member $\mathbf{35}_2$ which are adjacent to one another. The fastener $\mathbf{62}_1$ is operable to adjust a position in which the cuff member $\mathbf{35}_1$ and the cuff member $\mathbf{35}_2$ are fastened in order to adjust the cuff 14, including, in this case, the flare of the cuff 14. In this example of implementation, the cuff member $\mathbf{35}_1$ and the cuff member $\mathbf{35}_2$ overlap when fastened. The fastener $\mathbf{62}_1$ is operable to vary an overlap of the cuff member $\mathbf{35}_1$ and the cuff member $\mathbf{35}_2$ to adjust the position in which the cuff member $\mathbf{35}_1$ and the cuff member $\mathbf{35}_2$ are fastened. For instance, the position in which the cuff members $\mathbf{35}_1$, $\mathbf{35}_2$ are fastened and their overlap in FIG. 6A are respectively different from the position in which the cuff members $\mathbf{35}_1$, $\mathbf{35}_2$ are fastened and their overlap in FIG. 6B.

Similarly, in this embodiment, the fastener $\mathbf{62}_2$ is configured to fasten the cuff member $\mathbf{35}_2$ and the cuff member $\mathbf{35}_3$ which are adjacent to one another. The fastener $\mathbf{62}_2$ is operable to adjust a position in which the cuff member $\mathbf{35}_2$ and the cuff member $\mathbf{35}_3$ are fastened in order to adjust the cuff 14, including, in this case, the flare of the cuff 14. In this example of implementation, the cuff member $\mathbf{35}_2$ and the cuff member $\mathbf{35}_3$ overlap when fastened, and the fastener $\mathbf{62}_2$ is operable to vary an overlap of the cuff member $\mathbf{35}_2$ and the cuff member $\mathbf{35}_3$ to adjust the position in which the cuff member $\mathbf{35}_2$ and the cuff member $\mathbf{35}_3$ are fastened.

In this example of implementation, through the fasteners $\mathbf{62}_1$ and $\mathbf{62}_2$, the cuff adjuster 60 thus allows the player to omnidirectionally adjust the positions in which the cuff members $\mathbf{35}_1$-$\mathbf{35}_3$ are fastened to one another. For example, the position in which the cuff member $\mathbf{35}_1$ is fastened to the cuff member $\mathbf{35}_2$ may be adjusted in any desired direction.

In this embodiment, the glove 10 also comprises a sub-cuff 70 disposed under the cuff 14, attachable to at least one of the player's wrist and forearm, and movable relative to the cuff 14 when the player's wrist is flexed. This may provide additional protection to the player's wrist and/or forearm (e.g., if the player's wrist is flexed so much that the cuff 14 is moved sufficiently far to expose part of the player's wrist and/or forearm that the cuff 14 usually covers).

More particularly, in this embodiment, the sub-cuff 70 comprises a band 72 configured to be wrapped about the player's wrist and/of forearm. The band 72 has a first longitudinal end 74 and a second longitudinal end 76 that are movable relative to one another to wrap and unwrap the band 72 about the player's wrist and/or forearm. The sub-cuff 70 comprises a fastener 78 operable to secure the sub-cuff 70 to the player's wrist and/or forearm. In this example, the fastener 78 comprises fastening elements $\mathbf{81}_1$, $\mathbf{81}_2$ respectively disposed adjacent ones of the longitudinal ends 74, 76 of the band 72. For instance, in this example of implementation, the fastener 78 comprises a hook-and-loop fastener, wherein a hook connector is disposed adjacent the longitudinal end 74 and a loop connector is disposed adjacent the longitudinal end 76. The fastener 78 may be affixed to the band 72 in any suitable way, such as for example stitching, an adhesive, or ultrasonic welding amongst others.

In this embodiment, the band 72 of the sub-cuff 70 comprises protective padding disposed between an inner liner and an outer cover. For example, in some embodiments, these components may include materials such as those respectively described above in respect of the protective padding 52, the inner liner 43 and the outer cover 56 of the cuff 14.

The sub-cuff 70 may be attached to a remainder of the glove 10 in any suitable way. In this embodiment, the sub-cuff 70 is attached to the hand covering 12 by elastic members 911, 912 that allow the sub-cuff 70 to move relative to the hand covering 12 when the player's wrist bends.

In addition, in this embodiment, the glove 10 comprises a wrist guard 80 disposed over a junction 82 between the hand covering 12 and the cuff 14 to provide additional protection in that area, which bends significantly when the player flexes his/her wrist.

The glove 10, including the cuff 14 and its cuff adjuster 60, may be constructed in various other ways in other embodiments.

Figure 8:
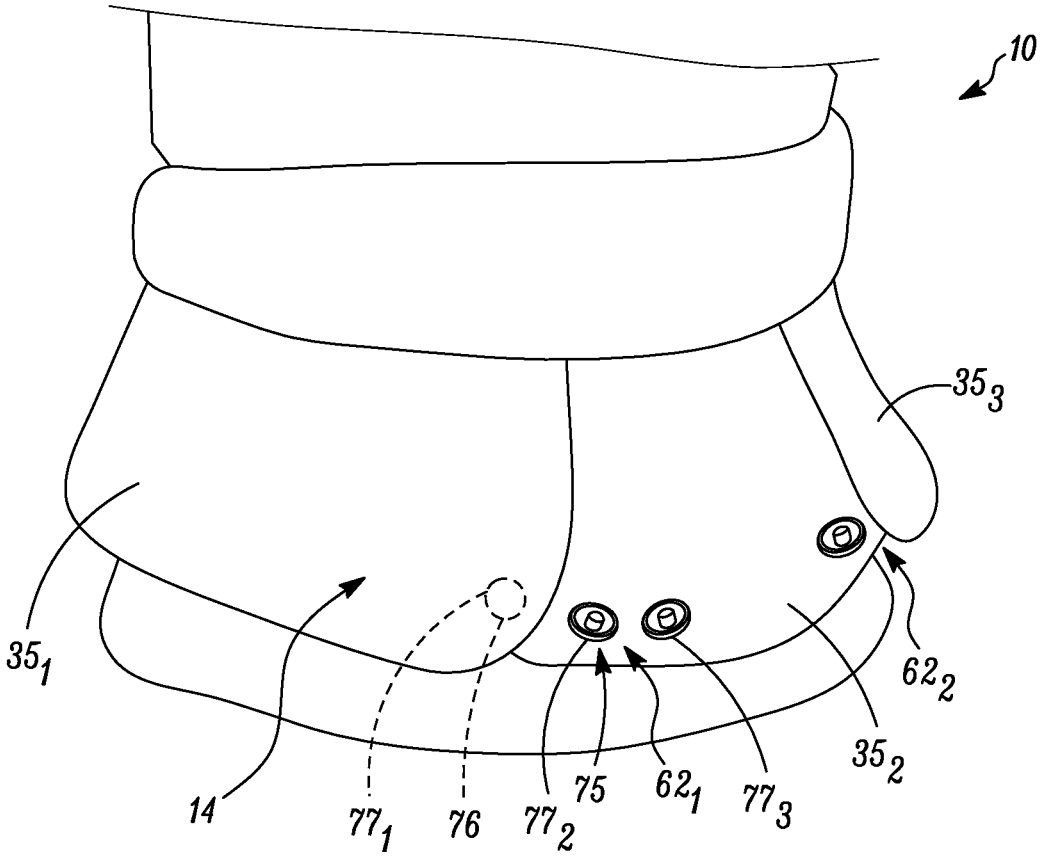
FIG. 8 shows a variant of the sports glove using another type of fasteners.

For example, in other embodiments, each of the fasteners $\mathbf{62}_1$, $\mathbf{62}_2$ of the cuff adjuster 60 may be any other type of fastener (e.g., a button, a clip, a buckle, a snap, etc.). For instance, in some embodiments, as shown in FIG. 8, the fastener $\mathbf{62}_1$ may comprise (1) a fastening element 75 on the cuff member $\mathbf{35}_2$ that comprises a plurality of distinct connecting elements $\mathbf{77}_1$-$\mathbf{77}_3$ which are spaced apart from one another and (2) a fastening element 76 on the cuff member $\mathbf{35}_1$ that can be connected to a selected one of these distinct connecting elements $\mathbf{77}_1$-$\mathbf{77}_3$ to adjust the position in which the cuff members $\mathbf{35}_1$, $\mathbf{35}_2$ are fastened. For example, in some cases, the distinct connecting elements $\mathbf{77}_1$-$\mathbf{77}_3$ of the fastening element 75 may be female snap button elements and the fastening element 76 may be a male snap button element that can be connected to a selected one of the female snap button elements (i.e., a button fastener). In other cases, the distinct connecting elements $\mathbf{77}_1$-$\mathbf{77}_3$ of the fastening element 75 may be grommets and the fastening element 76 may comprise a plug that can be connected to a selected one of the grommets by insertion therethrough (i.e., a plug-and-grommet fastener). The fastener $\mathbf{62}_2$ may be similarly configured. Various other types of fastening elements may be used in other embodiments.

As another example, in other embodiments, the cuff adjuster 60 may comprise any number of fasteners such as the fasteners $\mathbf{62}_1$, $\mathbf{62}_2$ (e.g., a single fastener or three or more fasteners).

As another example, in other embodiments, the cuff 14 may comprise any other number of cuff members such as the cuff members $\mathbf{35}_1$-$\mathbf{35}_3$ (e.g., two cuff members only, or four or more cuff members). In other embodiments, the cuff 14 may not be have a "split cuff" design (i.e., may not have cuff members movable relative to one another but rather is a single continuous piece).

While in this embodiment the glove 10 is a lacrosse glove, in other embodiments, a sports glove constructed using principles described herein in respect of the glove 10 may be another type of sports glove for a player playing another type of contact sport (sometimes referred to as "full-contact sport" or "collision sport") in which there are significant impact forces on the player due to player-to-player and/or player-to-object contact. For example, in other embodiments, a sports glove constructed using principles described herein in respect of the glove 10 may be a hockey glove for a hockey player playing hockey.

Any feature of any embodiment discussed herein may be combined with any feature of any other embodiment discussed herein in some examples of implementation.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

Although various embodiments and examples have been presented, this was for the purpose of describing, but not limiting, the invention. Various modifications and enhancements will become apparent to those of ordinary skill in the art and are within the scope of the invention, which is defined by the appended claims.

The invention claimed is:

1. A sports glove for a wearer, the sports glove comprising:

a hand covering for protecting a hand of the wearer, the hand covering comprising protective padding, the hand covering comprising a palm portion for overlying a palm of the wearer's hand, a back portion for overlying a back of the wearer's hand, finger portions for receiving fingers of the wearer's hand, and a thumb portion for receiving a thumb of the wearer's hand;

a cuff for overlying a wrist of the wearer; and a junction between the hand covering and the cuff, wherein the cuff comprises protective padding and is split into a plurality of distinct cuff members, wherein each of the plurality of distinct cuff members comprises a rear edge and a front edge, the front edge being joined to the hand covering at the junction, a first cuff member of the plurality of cuff members having (i) a first adjustable fastening element configured to fasten the first cuff member to a second cuff member of the plurality of cuff members to provide an adjustable first amount of overlap between the first and second cuff members; and (ii) a second adjustable fastening element configured to fasten the first cuff member to a third cuff member of the plurality of cuff members to provide an adjustable second amount of overlap between the first and third cuff members, the first and second fastening elements being adjustable to adjust a flare of the cuff relative to the hand covering by adjusting the first and second amounts of overlap as the front edge of the first cuff member, the front edge of the second cuff member and the front edge of the third cuff member remain joined to the hand covering at the junction.

2. The sports glove of claim 1, wherein the first and second fastening elements are adjustable to adjust the flare of the cuff to a selected one of a plurality of positions to adjust a flare angle between the cuff and the hand covering to a corresponding one of a plurality of selectable flare angle values that the flare angle can have when the sports glove is worn.

3. The sports glove of claim 1, wherein the first and second fastening elements each comprise a hook-and-loop fastener.

4. The sports glove of claim 1, wherein the plurality of distinct cuff members are movable relative to one another.

5. The sports glove of claim 1, wherein the first and second fastening elements are adjustable to omnidirectionally adjust a position in which the cuff members are fastened.

6. The sports glove of claim 1, comprising a sub-cuff disposed under the cuff, attachable to at least one of the wrist and the forearm of the wearer, and movable relative to the cuff when the wrist of the wearer is flexed.

7. The sports glove of claim 1, comprising a wrist guard disposed over the junction between the hand covering and the cuff.

8. The sports glove of claim 1, wherein the sports glove is a lacrosse glove.

9. The sports glove of claim 1, wherein the first and second fastening elements are disposed away from opposite longitudinal end regions of the cuff.

10. A sports glove for a wearer, the sports glove comprising:

a hand covering for protecting a hand of the wearer, the hand covering comprising protective padding, the hand covering comprising a palm portion for overlying a palm of the wearer's hand, a back portion for overlying a back of the wearer's hand, finger portions for receiving fingers of the wearer's hand, and a thumb portion for receiving a thumb of the wearer's hand;

a cuff for overlying a wrist of the wearer;

a junction between the hand covering and the cuff, wherein the cuff comprises protective padding and is split into a plurality of distinct cuff members, wherein each of the plurality of distinct cuff members comprises a rear edge and a front edge, the front edge being joined to the hand covering at the junction, a first cuff member of the plurality of cuff members having (i) a first adjustable fastening element configured to fasten the first cuff member to a second cuff member of the plurality of cuff members to provide an adjustable first amount of overlap between the first and second cuff member; and (ii) a second adjustable fastening element configured to fasten the first cuff member to a third cuff member of the plurality of cuff members to provide an adjustable second amount of overlap between the first and third cuff members;

the first and second fastening elements being adjustable to adjust a flare of the cuff relative to the hand covering by adjusting the first and second amounts of overlap as the front edge of the first cuff member, the front edge of the second cuff member and the front edge of the third cuff member remain joined to the hand covering at the junction; and an interconnector adjustably interconnecting the second cuff member and the third cuff member, wherein the first and second fastening elements and the interconnector are connected to opposite longitudinal end regions of the second and third cuff members.

11. The sports glove of claim 10, wherein the first and second fastening elements are adjustable to omnidirectionally adjust a position in which the cuff members are fastened.

12. The sports glove of claim 10, wherein the first and second fastening element each comprise a hook-and-loop fastener.

13. The sports glove of claim 10, comprising a sub-cuff disposed under the cuff, attachable to at least one of the wrist and a forearm of the wearer, and movable relative to the cuff when the wrist of the wearer is flexed.

14. The sports glove of claim 10, comprising a wrist guard disposed over the junction between the hand covering and the cuff.

15. The sports glove of claim 10, wherein the sports glove is a lacrosse glove.

16. A sports glove for a wearer, the sports glove comprising:

a hand covering for protecting a hand of the wearer, the hand covering comprising protective padding, the hand covering comprising a palm portion for overlying a palm of the wearer's hand, a back portion for overlying a back of the wearer's hand, finger portions for receiving fingers of the wearer's hand, and a thumb portion for receiving a thumb of the wearer's hand;

a cuff for overlying a wrist of the wearer; and a junction between the hand covering and the cuff, wherein the cuff comprises protective padding and is split into a plurality of distinct cuff members, wherein each of the plurality of distinct cuff members comprises a rear edge and a front edge, the front edge being joined to the hand covering at the junction, a first cuff member of the plurality of cuff members having (i) a first adjustable fastening element configured to fasten the first cuff member to a second cuff member of the plurality of cuff members to provide an adjustable first amount of overlap between the first and second cuff members; and (ii) a second fastening element configured to fasten the first cuff member to a third cuff member of the plurality of cuff members to provide an adjustable second amount of overlap between the first and third cuff members, the first and second fastening elements being adjustable to adjust a flare of the cuff relative to the hand covering by adjusting the first and second amounts of overlap as the front edge of the first cuff member, the front edge of the second cuff member and the front edge of the third cuff member remain joined to the hand covering at the junction;

wherein the first and second fastening elements are configured to be disposed above at least one of the wrist and a forearm of the wearer when the sports glove is worn.

17. A sports glove for a wearer, the sports glove comprising:

a hand covering for protecting a hand of the wearer, the hand covering comprising protective padding, the hand covering comprising a palm portion for overlying a palm of the wearer's hand, a back portion for overlying a back of the wearer's hand, finger portions for receiving fingers of the wearer's hand, and a thumb portion for receiving a thumb of the wearer's hand;

a cuff for overlying a wrist of the wearer;

a junction between the hand covering and the cuff, wherein the cuff comprises protective padding and is split into a plurality of distinct cuff members, wherein each of the plurality of distinct cuff members comprises a rear edge and a front edge, the front edge being joined to the hand covering at the junction, a first cuff member of the plurality of cuff members having (i) a first adjustable fastening element configured to fasten the first cuff member to a second cuff member of the plurality of cuff members to provide an adjustable first amount of overlap between the first and second cuff members; and (ii) a second adjustable fastening element configured to fasten the first cuff member to a third cuff member of the plurality of cuff members to provide an adjustable second amount of overlap between the first and third cuff members;

the first and second fastening elements being adjustable to adjust a flare of the cuff relative to the hand covering by adjusting the first and second amounts of overlap as the front edge of the first cuff member, the front edge of the second cuff member and the front edge of the third cuff member remain joined to the hand covering at the junction; and an interconnector adjustably interconnecting the second cuff member and the third cuff member by being configured to extend underneath at least one of the wrist and a forearm of the wearer when the sports glove is worn.

18. The sports glove of claim 17, wherein the interconnector comprises a lace.

19. The sports glove of claim 17, wherein causing the first and second fastening elements to increase the flare of the cuff relative to the hand covering causes the first cuff member to become more exposed.

20. The sports glove of claim 17, wherein causing the first and second fastening elements to increase the flare of the cuff relative to the hand covering increases a spacing between longitudinal end regions of the second cuff member and the third cuff member, the longitudinal end regions of the second and third cuff members facing one another.

21. A sports glove for a wearer, the sports glove comprising:

a hand covering for protecting a hand of the wearer, the hand covering comprising protective padding, the hand covering comprising a palm portion for overlying a palm of the wearer's hand, a back portion for overlying a back of the wearer's hand, finger portions for receiving fingers of the wearer's hand, and a thumb portion for receiving a thumb of the wearer's hand;

a cuff for overlying a wrist of the wearer; and a junction between the hand covering and the cuff, wherein the cuff comprises protective padding and is split into a plurality of distinct cuff members, wherein each of the plurality of distinct cuff members comprises a rear edge and a front edge, the front edge being joined to the hand covering at the junction, a first cuff member of the plurality of cuff members having (i) a first adjustable fastening element configured to fasten the first cuff member to a second cuff member of the plurality of cuff members to provide an adjustable first amount of overlap between the first and second cuff members; and (ii) a second adjustable fastening element configured to fasten the first cuff member to a third cuff member of the plurality of cuff members to provide an adjustable second amount of overlap between the first and third cuff members;

the first and second fastening elements being adjustable to adjust a flare of the cuff relative to the hand covering by adjusting the first and second amounts of overlap as the front edge of the first cuff member, the front edge of the second cuff member and the front edge of the third cuff member remain joined to the hand covering at the junction, the first and second fastening elements being configured to not extend underneath at least one of the wrist and a forearm of the wearer when the sports glove is worn.

22. A sports glove for a wearer, the sports glove comprising:

a hand covering for protecting a hand of the wearer, the hand covering comprising protective padding, the hand covering comprising a palm portion for overlying a palm of the wearer's hand, a back portion for overlying a back of the wearer's hand, finger portions for receiving fingers of the wearer's hand, and a thumb portion for receiving a thumb of the wearer's hand;

a cuff for overlying a wrist of the wearer; and a junction between the hand covering and the cuff, wherein the cuff comprises protective padding and is split into a plurality of distinct cuff members, wherein each of the plurality of distinct cuff members comprises a rear edge and a front edge, the front edge being joined to the hand covering at the junction, a first cuff member of the plurality of cuff members having (i) a first adjustable fastening element configured to fasten the first cuff member to a second cuff member of the plurality of cuff members to provide an adjustable first amount of overlap between the first and second cuff members; and (ii) a second adjustable fastening element configured to fasten the first cuff member to a third cuff member of the plurality of cuff members to provide an adjustable second amount of overlap between the first and third cuff members;

the first and second fastening elements being adjustable to adjust a flare of the cuff relative to the hand covering by adjusting the first and second amounts of overlap as the front edge of the first cuff member, the front edge of the second cuff member and the front edge of the third cuff member remain joined to the hand covering at the junction, the first and second fastening element being configured to be disposed away from an underside of the wrist and a forearm of the wearer when the sports glove is worn.

* * * * *